United States Patent [19]

Yip et al.

[11] Patent Number: 4,816,003

[45] Date of Patent: Mar. 28, 1989

[54] TEETHING RING WITH AN ENCLOSED AMUSEMENT MEMBER ON A DIAMETRAL SHAFT

[75] Inventors: Chun-Kuen Yip; Chun-Tong Yip, both of Hong Kong, Hong Kong

[73] Assignee: Chun Yip Silver Ware Limited, Hong Kong, Hong Kong

[21] Appl. No.: 33,287

[22] Filed: Apr. 2, 1987

[30] Foreign Application Priority Data

May 22, 1986 [GB] United Kingdom ..... 8612463

[51] Int. Cl.[4] ..... A63H 5/00

[52] U.S. Cl. ..... 446/419; 446/227; 446/265; 128/359

[58] Field of Search ..... 446/227, 236, 237, 265, 446/269, 270, 418, 419, 411, 412, 413, 421, 450; 128/359

[56] References Cited

U.S. PATENT DOCUMENTS

| | | | |
|---|---|---|---|
| 447,164 | 2/1891 | Simpson | 128/359 |
| 1,117,093 | 11/1914 | Ripley | 446/419 |
| 1,185,341 | 5/1916 | Morse | 446/265 |
| 1,720,038 | 7/1929 | Feldstein | 446/419 |
| 2,112,316 | 3/1938 | Turner | 128/359 |
| 2,351,762 | 6/1940 | Hoover | 446/269 |
| 2,532,116 | 11/1950 | Monaco | 446/419 |
| 2,717,473 | 9/1955 | Moore | 128/359 |
| 2,766,757 | 10/1956 | Zelony | 128/359 |
| 3,464,151 | 9/1969 | Motley | 446/419 |

OTHER PUBLICATIONS

Marlin Toy Products, "Birdie Ball", Mar. 10, 1966.

*Primary Examiner*—Robert A. Hafer
*Assistant Examiner*—Charles H. Harris
*Attorney, Agent, or Firm*—Pollock, Vande Sande, and Priddy

[57] ABSTRACT

A combined teething ring and rattle in which the rattle is rotatably mounted on a continuous shaft which extends through the rattle and into bores in the ring. The shaft is held in place in the ring by plugs which seal the open ends of the bores and which are permanently secured in place, such as by gluing or welding.

6 Claims, 1 Drawing Sheet

TEETHING RING WITH AN ENCLOSED AMUSEMENT MEMBER ON A DIAMETRAL SHAFT

This invention relates to infant's toys and in particular to a combined teething ring and rattle for infants.

BACKGROUND TO THE INVENTION

One combined teething ring and rattle which has been on the market for many years consists of a plastic teething ring having an amusement component rotatably supported within it. For example, this component can be in the shape of an animal or bird, is usually hollow and contains small solid particles which enable it to act as a rattle.

The rotating component is usually supported in the middle of the teething ring by a pair of pins which project radially inwardly from diametrically opposed positions on the ring. The pins are fixed at the outer ends in the ring and the central rotating component has a pair of holes through which the ends of the pins project.

It has been found however that after long usage, it is possible in some circumstances for the central rotating component or rattle to become separated from the teething ring. This can cause dangers with infants who may swallow the component and so are liable to suffocate. In addition, the pins themselves will be sharp and may cause injury.

It is therefore an object to this invention to provide a combined rattle and teething ring which avoids these hazards.

BRIEF SUMMARY OF THE INVENTION

According to the invention, there is provided a teething ring having an amusement member rotatably mounted therein. The ring comprises a continuous ring molded of hard, rigid, synthetic plastic material and having formed therein a pair of substantially diametric bores which pass entirely through the ring and have outer ends. A shaft is fixed substantially diametrically across the ring and extends into both of the bores. Also, the shaft has shaft ends and a length which is less than the outer diameter of the ring. Plugs are permanently secured in the outer ends of the bores closely adjacent each of the shaft ends. Also, the ring is sufficiently hard and the shaft is sufficiently long for rendering impossible any dislodgment of the shaft during normal usage. The amusement member is rotatably supported on the shaft within the ring.

With such an arrangement, the shaft is now permanently held in place by the plugs. These can conveniently be plugs of plastic which are glued, welded or otherwise permanently adhered in the open ends of the bores so permanently securing the shaft in place. Preferably the shaft ends are closely surrounded by the walls of the bores.

The amusement member can for example be a hollow brass-shaped figure, optionally coated with silver, containing a number of small, loosely confined particles which act as a rattle when and the shaft extends shaken all the way through this component. Therefore appropriate holes are provided at the opposite ends of the component for this purpose. If desired, a pair of sleeves may surround the shaft so as to act as spacers between the component and the surrounding ring.

DESCRIPTION OF THE DRAWINGS

The invention will now be described, by way of example, with reference to the accompanying drawings, in which.

DESCRIPTION OF THE PREFERRED EMBODIMENT

Figure 1:
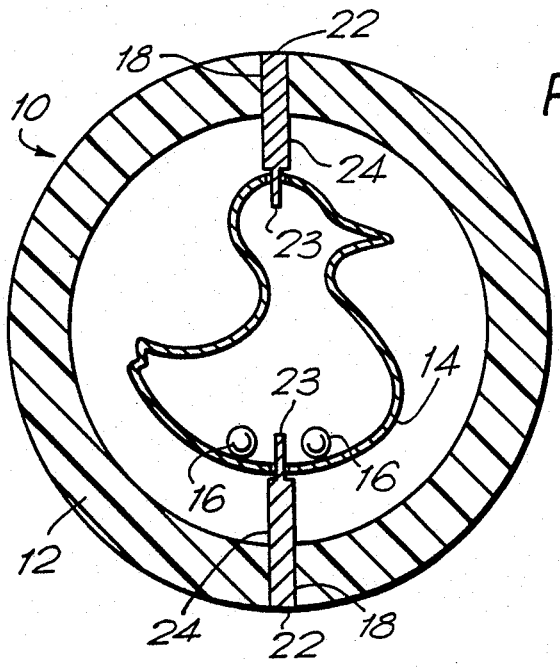
FIG. 1 is a section through a prior art combined teething ring and rattle.

Referring first of all to the prior art toy of FIG. 1, the teething ring and rattle combination 10 has an outer ring 12 moulded from a hard synthetic plastic such as polystyrene. Rotatably mounted within it is a duck-shaped rattle 14, although the rattle can be of any other desired shape such as a heart or other animal. This shaped object is conveniently made of metal such as brass and is hollow. For convenience, it has been given a silver coating, e.g. by electrodeposition. Contained within it are a number of small particles 16 which give a rattle sound when the ring and rattle combination is shaken.

A pair of metal pins 18 project inwardly at diametrically opposed positions of the ring. These pins have heads 22 which lay flush with the outer circumference of the ring and the pins are wedged in place by the friction between them and the material of the ring. The inner ends 23 of the pins are narower and project through small holes into the duck-shaped rattle 14. It will be noted that these pins project only a short way into the rattle. The wider main portions 24 of the pins abut the rattle 14 and locate it.

It will be appreciated that the rattle 14 is free to rotate about the pins 18 relative the outer teething ring 12.

Such an arrangement has dangers in that under sufficient pressure, the pins may bend out of line with the ring or may be displaced radially outwardly with the result that the central duck-shaped rattle 14 can come free. The resulting pins and the rattle may be dangerous if swallowed by an infant.

Figure 2:
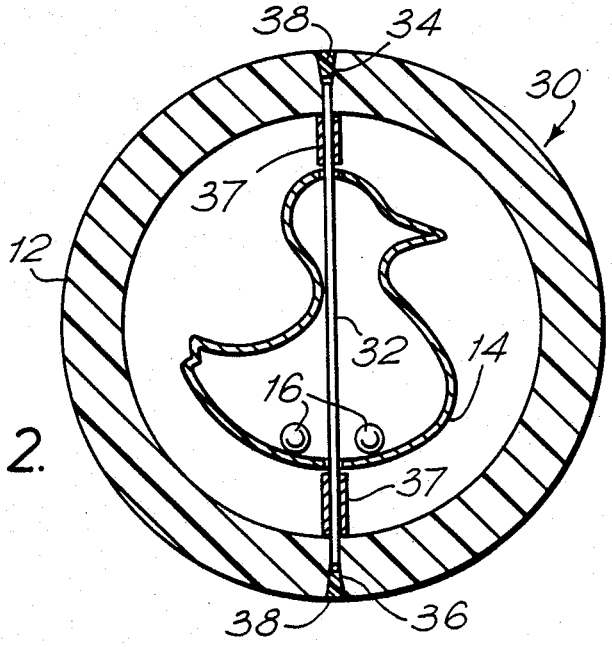
FIG. 2 is a similar section of a combined teething ring and rattle according to the invention.

The modified item 30 according to the invention is shown in FIG. 2 where like reference numerals designate like parts. The outer teething ring 12 and the rattle 14 are identical and will not be further described. However, the rattle is mounted about a single metal shaft 32. This extends into a pair of diametrically aligned bores 34 and 36 in the ring and sleeves 37 surround the shaft 32 so as to space the rattle 14 from the ring 12.

The length of the shaft 32 is less than the overall maximum diameter of the ring 14 so that its ends stop short of the ends of the bores 34 and 36. In order to secure the shaft in place, however, a pair of plastic plugs 38 are provided which seal the ends of the bores 34 and 36 and hold the shaft 32 in place. The plugs fit substantially flush with the outer surface of the ring.

The plugs are permanently fitted into the ends of the bores by glueing with an appropriate glue or, alternatively, by heat welding or the like. The main thing is that they are permanently joined to the ring and so permanently hold the shaft 32 in place.

It will be noted that the length of the shaft is approximately equal to the inner diameter of the ring plus approximately its radial thickness so that it is impossible for the shaft to be dislodged during normal usage.

Therefore, with the combined rattle and teething ring 30 according to the invention as shown in FIG. 2, the danger of the rattle 14 becoming separated is eliminated because the single metal shaft 32 cannot easily be bent out of line or displaced. This also avoids the danger of having the pair of sharp metal pins 24 exposed if the item breaks as explained in connection with FIG. 1.

An important advantage of the invention is its simplicity since it can be seen that relatively small changes in the overall structure can provide an entirely safe item, and significant changes in the major components such as the teething ring 12 and the central rattle 14 are not required.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

We claim:

1. A teething ring having an amusement member rotatably mounted therein and comprising:

a continuous ring molded of hard rigid synthetic plastic material and having formed therein a pair of substantially diametric bores which pass entirely through the ring and have outer ends, a shaft fixed substantially diametrically across said ring and extending into both of said bores, said shaft having shaft ends and a length which is less than the outer diameter of the ring, plugs permanently secured in said outer ends of said bores closely adjacent each of the shaft ends, said ring being sufficiently hard and said shaft being sufficiently long for rendering impossible dislodgment of the shaft during normal usage, and said amusement member being rotatably supported on said shaft within said ring.

2. A teething ring according to claim 1 wherein the amusement member is a hollow rattle component within which are loosely confined particles for causing a rattling sound when shaken.

3. A teething ring according to claim 1 wherein the shaft ends are closely surrounded by the walls of said bores.

4. A teething ring according to claim 1 wherein said plugs are glued or welded into said ends of said bores flush with the outer surface of said ring.

5. A teething ring according to claim 1 wherein said rattle component is in the shape of a figure, said shaft extending through said rattle, holes being provided at opposite ends of said figure for the shaft to extend through.

6. A teething ring according to claim 1 further comprising sleeves surrounding said shaft to act as spacers between said rattle component and said ring.

* * * * *